United States Patent [19]

Pinto et al.

[11] Patent Number: 4,661,025

[45] Date of Patent: Apr. 28, 1987

[54] APPARATUS FOR FORMING A FIBER COLUMN IN A CHUTE FEED

[75] Inventors: Akiva Pinto, Gastonia, N.C.; Guenther Lucassen, Haltern, Fed. Rep. of Germany

[73] Assignee: Hergeth Hollingsworth GmbH, Duelmen, Fed. Rep. of Germany

[21] Appl. No.: 758,369

[22] Filed: Jul. 24, 1985

[51] Int. Cl.[4] ..... B65G 53/48

[52] U.S. Cl. ..... 406/70; 19/105; 193/2 R; 406/159; 406/171

[58] Field of Search ..... 406/70, 168, 171, 157, 406/159–161; 193/2 R; 19/105; 222/630

[56] References Cited

U.S. PATENT DOCUMENTS

| | | | |
|---|---|---|---|
| 3,728,759 | 4/1973 | Hergeth | 406/28 X |
| 4,154,485 | 5/1979 | Lytton et al. | 406/70 |
| 4,523,351 | 6/1985 | Leifeld | 19/105 |
| 4,531,262 | 7/1985 | Reiche | 19/105 X |

FOREIGN PATENT DOCUMENTS 1457312 12/1976 United Kingdom .

*Primary Examiner*—Jeffrey V. Nase
*Assistant Examiner*—Daniel R. Edelbrock
*Attorney, Agent, or Firm*—Cort Flint

[57] ABSTRACT

Apparatus and method for forming a uniform fiber column in a chute feed (A) which includes an entrance opening (34) in a reserve section (30) of the chute at which an inclined air deflection vane (42) is pivoted for deflecting the incoming fiber-laden airflow downwardly in nonturbulent, uniform flow paths. A fiber column (F) with a level top surface (43) is provided along the entire length (L) of the reserve chute (40). An adjustable width throat (B) in the reserve chute compacts and shapes the fibers into a fiber column having a desired form avoiding fiber drag down the chute walls. The adjustable throat includes a pair of longitudinal movable wall elements (66, 68). The wall elements may be adjusted and fixed in position to provide a throat cross-section having a desired width (W) or shape depending on the type fiber being fed.

17 Claims, 10 Drawing Figures

Fig. 2.
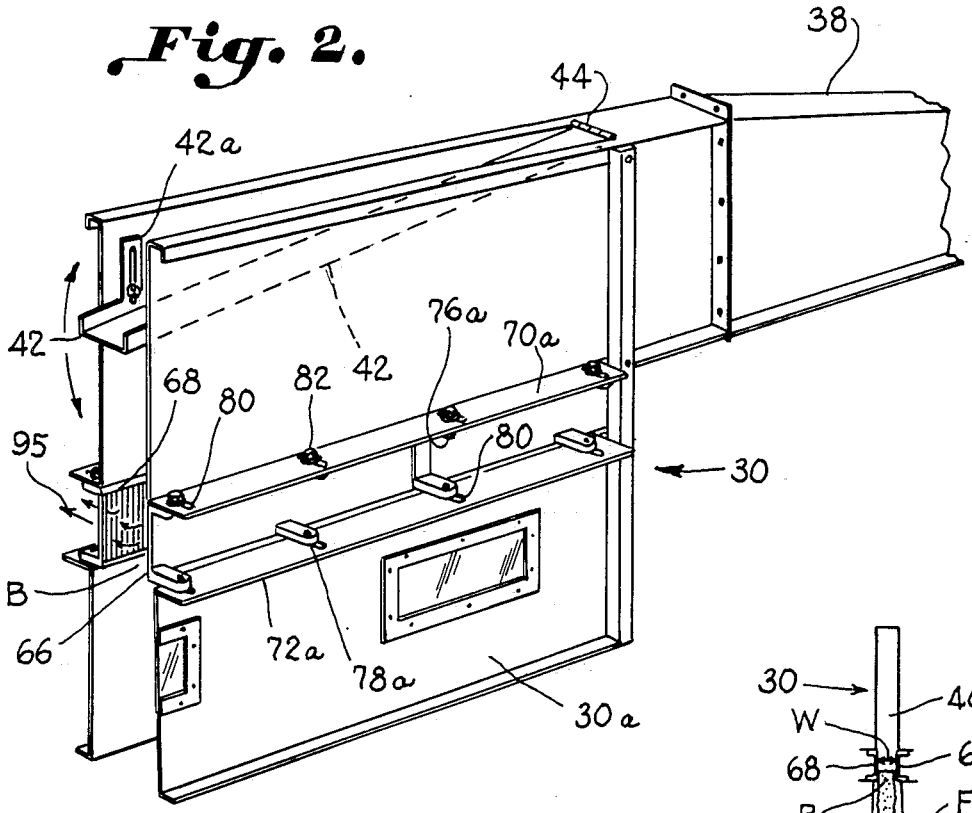
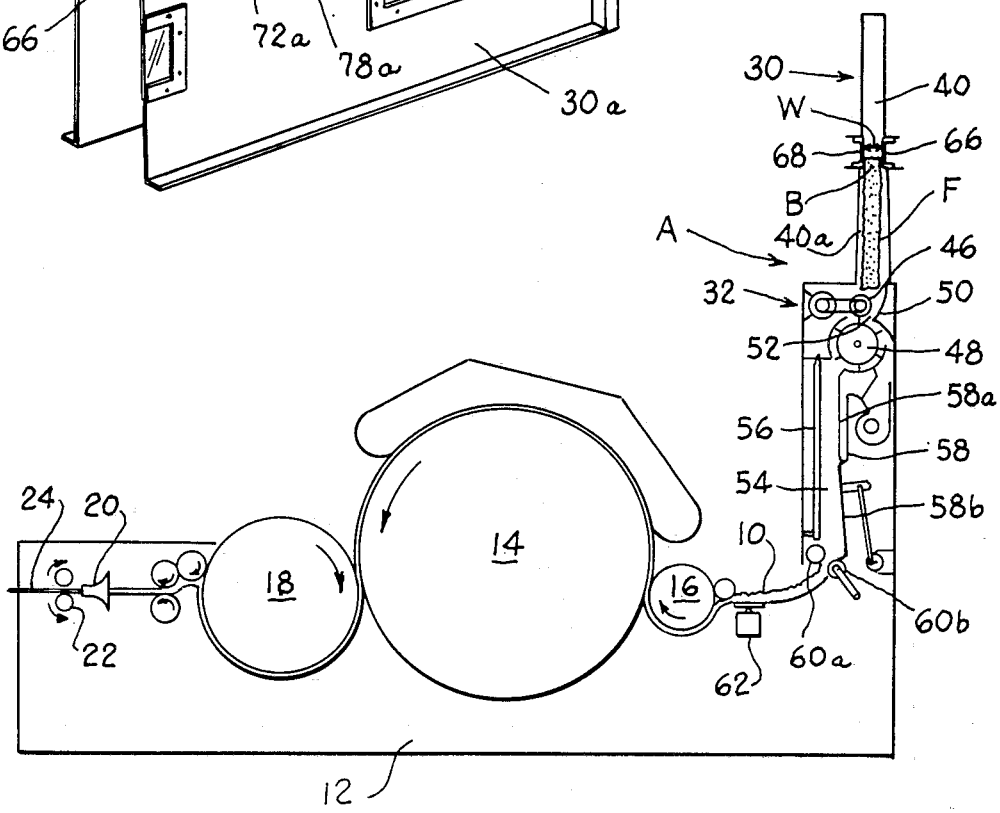
Fig. 1.

Fig. 6.
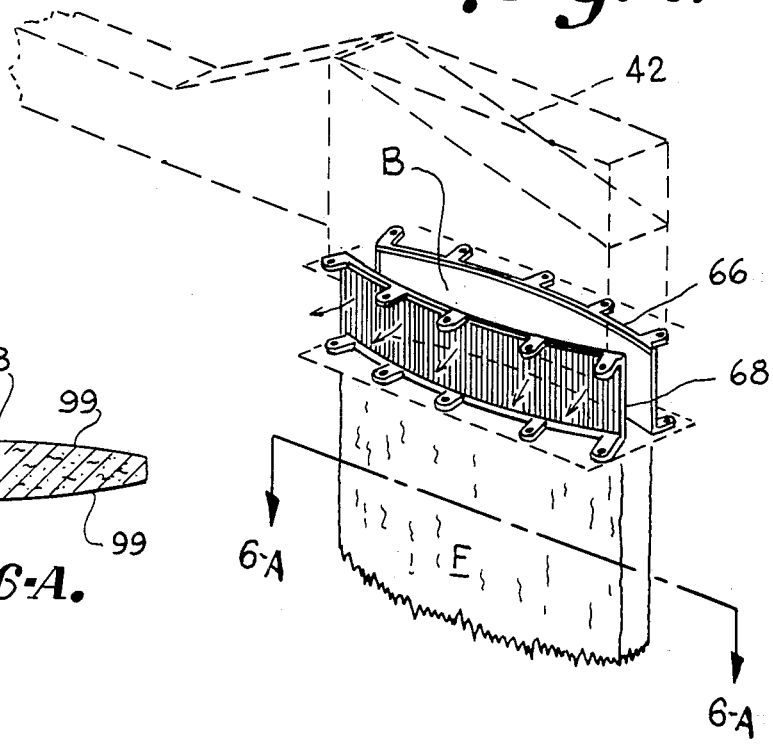
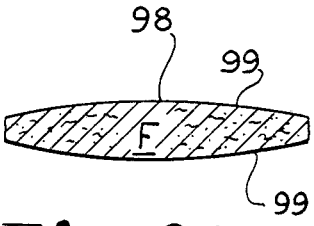
Fig. 6-A.
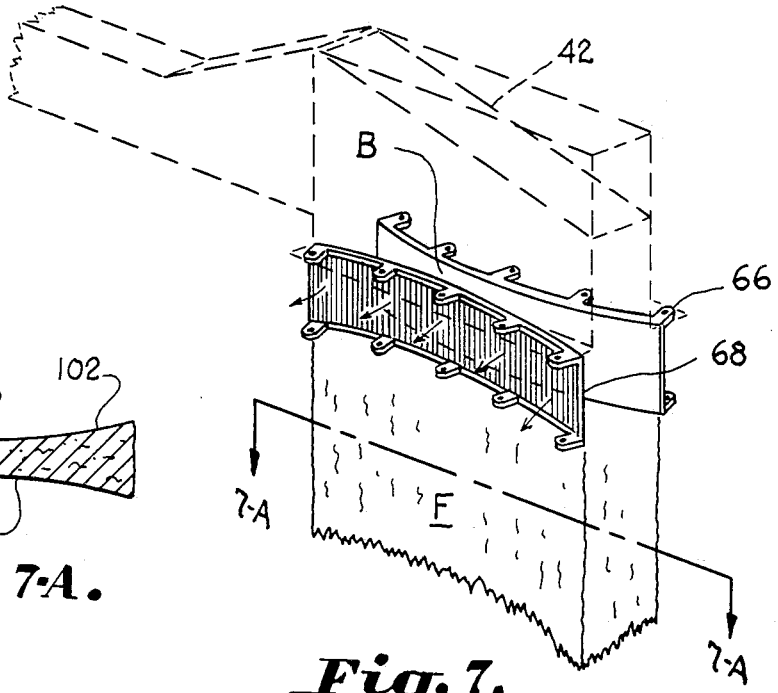
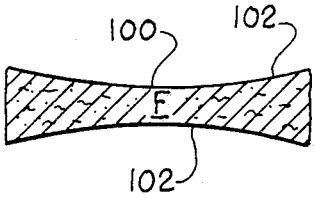
Fig. 7-A.
Fig. 7.

APPARATUS FOR FORMING A FIBER COLUMN IN A CHUTE FEED

BACKGROUND OF THE INVENTION

The inventio relates to a more uniform feeding of fibrous material from a chute to a carding or like machine in the form of a fiber batt. Various forms of chute feeds have been heretofore provided which typically include a vertical chute having a reserve section and lower formation section. A top feed roll and fiber opening roll are disposed above the chute of the formation section for supplying opened fibrous material from the reserve section. A pair of bottom delivery rolls discharge the fibrous material in the form of a compacted batt.

The top feed roll feeds to the opening roller the fibers which have, to some extent, been previously opened and individualized. The further separated and opened fibers are then deposited into the formation section. In the formation section, an oscillating compacting plate compresses and compacts the fibers to increase and make more uniform the bulk density of the fibers prior to entering the nip of the bottom delivery rolls. By controlling the speed and degree of movement of the oscillating plate the bulk density and volume of the fibrous batt can be prescribed. The performance of the compactor plate depends, in part, on the degree and uniformity of compaction of the fibers in the formation section.

In the reserve section, the formation of a reserve of fibers which are supplied at a uniform weight along the axial length of the feed roll is a problem to which considerable attention need be given. Typically, the fibers are formed in a reserve stack or column above the feed roll. However, the fiber drag produced on the front and rear interior walls of the reserve section can cause the fibers to form a column whose weight is non-uniform along the length of the walls. The feed roll, whose axis is parallel to the front and rear interior walls, receives a non-uniform weight of fibers along its length for feeding to the formation section below the feed roll.

The width of the column of fibers between the front and rear reserve section wall determines its weight. It would be highly desirable to be able to adjust the width of the fiber column and thus prescribe the weight of the column of fibers being fed by the feed roll to meet the needs of the application and type of fiber being fed. At the same time, feeding of the prescribed column without drag or other influences affecting the uniformity of the column is necessary.

Another problem in uniformly feeding the fibers has been the non-uniform compaction of fibers in the lower end of the reserve chute. With the fibers unevenly compacted, the feed roll cannot in turn feed the fibers in a uniform manner. Some reserve sections have walls which taper slightly outwards toward the feed roll, and the fibers become compacted in a wedge-shaped column above the feed roll. Often, the walls of the reserve section are perforated or of screen material to allow for the escape of air transporting the fibers. This occurs at a lower portion of the reserve chute which tightly compacts the fibers down against the lower walls.

The non-uniform feeding of fibers, whether from weight variations due to drag, overcompaction, or other factors, results in the feeding of non-uniform fiber tufts into the formation section. Lumps and irregularities result in bulk density variations in the fiber batt discharged from the chute feed.

Accordingly, an object of the present invention is to provide an apparatus and method for more uniformly supplying fibers in a chute feed and accurately prescribing the weight thereof.

Still another object of the present invention is to provide an apparatus and method for supplying fibers in a more uniform column of a prescribed shape in a reserve section of a chute feed for proper feeding of a prescribed weight of fibers to a formation section of the chute feed.

Still another object of the present invention is to provide an apparatus and method for supplying fibers in a fiber column having a predetermined shape which avoids drag against the chute walls and other factors tending to alter the uniform column shape.

Still another object of the present invention is to provide a chute feed having a reserve section with a pair of opposed adjustable sidewall elements which can be adjusted to shape a fiber column in the chute from which fiber is fed to an opening roll.

Yet another object of the present invention is to provide a chute feed in which fibers are supplied in a more uniform column of fibers having a desired width and a level surface along the top thereof for more precise feeding through the chute feed.

Devices which are superficially similar to the invention are those shown in German Patent (Patentschrift) DE 3149965 wherein a pivotal vane is disclosed mounted in a formation chute to vary the width of the fiber batt delivered to a card. U.S. Pat. No. 3,963,111 discloses a cotton gin feeder wherein the shaft or chute of the feeder may be operated as a single chamber or a double chamber by actuating movable side valves to vary feed rate.

SUMMARY OF THE INVENTION

The above objectives are accomplished according to the present invention by providing in the chute of the reserve section a pair of spaced, opposed, movable, longitudinal wall elements which may be adjusted to vary the width of a throat of the reserve chute. As the adjustable plates are moved towards each other, the width of the fiber column formed in the reserve chute is narrowed. One of the adjustable side plates consists of a grille construction having a plurality of side-by-side vertical slots rendering the plate air permeable. The air which transports the fibers into the reserve section from the opening machinery upstream exits the reserve chute through the grille of the wall element. This causes the fibers to be compacted and shaped between the wall elements and formed into a prescribed fiber column shape above the feed roll in the reserve chute below. The adjustable wall elements may also be made concave or convex with respect to each other to respectively bow the column of fibers outwardly or inwardly. By removing the flow of air at the throat, the fibers are compacted and held together by interfiber friction in the prescribed column above the top feed roll. The columnized fibers are out of contact with the chute front and rear walls to avoid drag and undue compaction. A true nip is formed between the feed roll and the feed plate, and the fibers are fed from the fiber column uniformly without feeding of large, non-uniform fiber tufts. The width of the fiber column is accurately controlled resulting in feeding of an even weight of fibers along the axial length of the feed roll. An inclined air control vane may also be utilized in an upper section of the reserve chute to distribute the fibers level along the top surface of the fiber column.

The weight of the column of fibers in the reserve chute may be easily changed by adjusting the width of the throat. The fibers are maintained out of contact with the chute walls to avoid drag. This is particularly useful for carding machine chute feeds having lengths greater than one meter and as long (across) as four or five meters wherein large drag variations occur along the length of the front and rear chute walls.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is an elevation illustrating a chute feed constructed in accordance with the present invention for feeding a fiber batt to a carding machine;

FIG. 2 is a perspective view of a reserve section of a chute feed constructed in accordance with the present invention;

FIG. 6 is a perspective view of a reserve section of a chute feed having movable wall elements for shaping a concave fiber column in accordance with the present invention;

FIG. 6A is a sectional view taken along line 6A—6A of FIG. 6;

FIG. 7 is a perspective view illustrating a reserve section having movable wall elements for forming a convex fiber column in accordance with the present invention;

FIG. 7A is a sectional view taken along line 7A—7A of FIG. 7.

DESCRIPTION OF A PREFERRED EMBODIMENT

Figure 3:
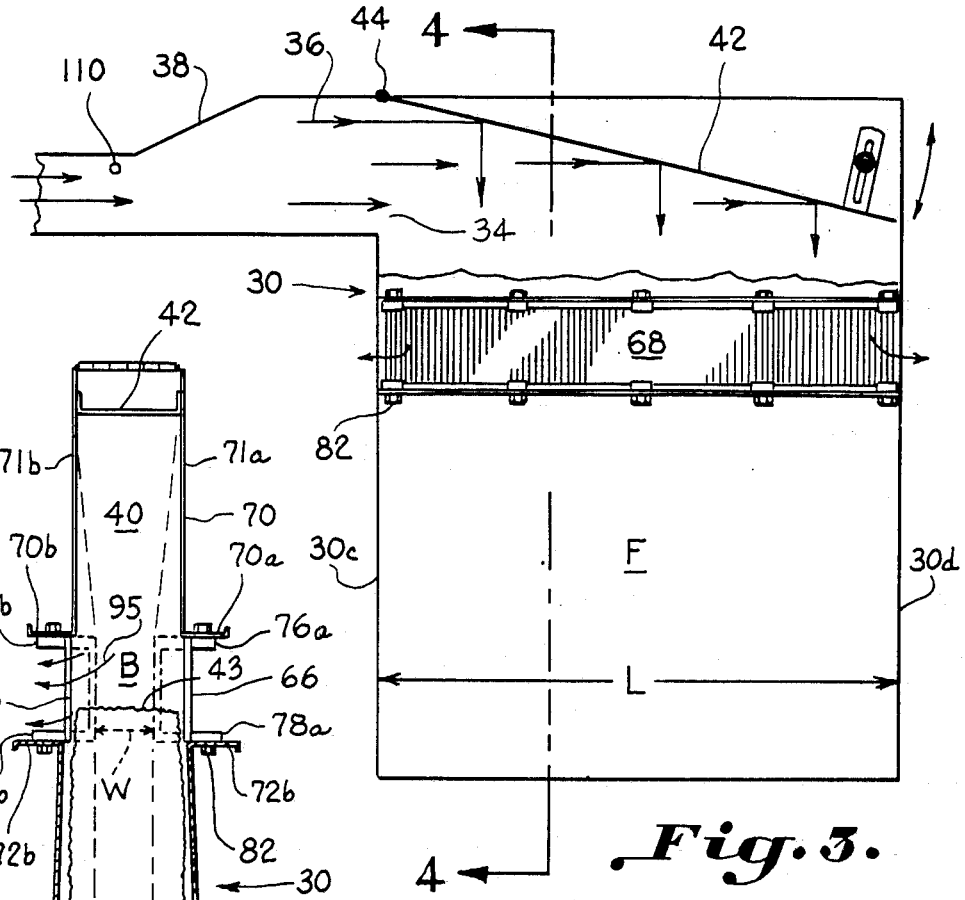
FIG. 3 is an elevation of a reserve section of a chute feed constructed in accordance with the present invention.

Referring now in more detail to the drawings, a chute feed designated generally as A is illustrated feeding a fiber batt 10 to a carding machine 12. The carding machine typically includes a main carding cylinder 14, and a lickerin roll 16 which feeds the fiber batt to the carding cylinder. There is a doffing roll 18 which takes the fibers off of the carding cylinder 14. The main function of the carding cylinder is to take the batt of fibers and remove the light waste matter and very short tangled fibers (neps). The remaining long fibers are carded into some degree of parallelism. The parallel fibers removed by the doffing cylinder are condensed through a trumpet 20 and drawn off by pairs of draw-off rolls 22 in the form of a sliver 24 in a conventional manner.

Referring now in more detail to the chute feed A, there is a reserve section, designated generally as 30, and a formation section, designated generally as 32. The reserve section 30 acts as a top transition for the formation section 32. Fibers enter the reserve section at an entrance 34 as can best be seen in FIG. 3. The fibers are transported into the reserve chute by a fiber-laden airflow which comes from a transport blower (not shown) connected to the fiber-opening machinery. The fiber-laden airflow is denoted by arrows 36 which expand in a divergent conduit section 38 in the form of a generally smooth, horizontal flow denoted by the arrows 36.

Reserve section 30 is constructed by a front wall 30*a*, rear wall 30*b*, and integral sidewalls 30*c* and 30*d*. The reserve section 30 includes a vertical chute 40 in which the fibers are deposited as they enter the entrance 34. The incoming airflow is preferably deflected by an air vane 42 which is pivoted at 44 adjacent an upper portion of the entrance and is inclined downwardly. The airflow and deflection vane 42 deflects the air from a horizontal flow to a vertical flow so that the fibers are depoisted in a column in the reserve chute with a generally level top surface 43. There is a uniform pressure of air acting on the top of the fiber so that the weight of the fibers is evenly distributed along the chute. The vane may be adjusted to provide the desired distribution depending on inflow conditions and fiber type.

There is a top feed roll 46 carried at the top of the formation section 32 and below the fiber column F for feeding the fibers from the fiber column to an opening roller 48. The feed roll 46 extends generally across the entire length, L, of the reserve chute 40. The opening roller 48 extends axially across the entire length of the top feed roll and is parallel with the feed roll. A feed plate 50 is disposed adjacent the feed roll 46 whereby a nip 52 is defined between the feed roll and feed plate. A formation chute 54 is formed in the formation section by a front wall 56 and a rear wall 58 which includes a perforated section 58*a* and an oscillating wall 58*b* which compacts the fibers in the formation section to provide a desired weight of the fiber batt 10. There is a pair of delivery rolls 60*a* and 60*b* which discharge the fiber batt after the fibers are compacted in a conventional manner. The weight of the fiber batt is detected by a conventional detector 62 which controls the speed of the oscillating wall 58*b* and the speed of the top feed roll 46 to provide the desired output in terms of the weight of the batt.

Having thus described the more general features, the invention will now be referred to in more detail. As can best be seen in FIGS. 2 through 4, there is a pair of movable wall elements carried in the front and back walls 30*a*, 30*b* of the reserve section which provide an adjustable throat means B in the reserve chute 40. The variable width throat means compacts and shapes the fibers passing through the throat to form a prescribed fiber column F in a portion 40*a* of the reserve chute for feeding to the top feed roll 46. By forming the fiber column F with a desired width and/or cross-section, the weight of fibers fed to the formation section and characteristics of the fiber batt discharged therefrom can be prescribed. Furthermore, air vane 42 allows for the distribution of the fibers across the length of the chute to be profiled as desired. The fibers may be level along the top surface 43 of the column F or may be distributed in a profile which is higher from one side of the chute to the other, all of which may be tailored by vane 42 to meet the needs of the fibers and application being made.

The movable walls of the adjustable throat means B include a first movable wall element 66 carried by the front wall 30*a* of the reserve section, and a second movable wall element 68 which is opposite the first movable wall and carried by the back wall 30*b* of the reserve section. As can best be seen in FIG. 3, movable walls 66 and 68 extend along the length, L, of the chute across the respective front and back walls thereof. The second movable wall element includes air passage openings for the removal of the transport air so that the fibers are compacted by the walls and formed by interfiber friction into the prescribed fiber column in the chute 40*b* below. The wall elements 66 and 68 are longitudinal and opposed from each other, and may be adjusted so that the distance (width, W) therebetween varies either uniformly or as a function which generates a concave or convex curve.

Figure 4:
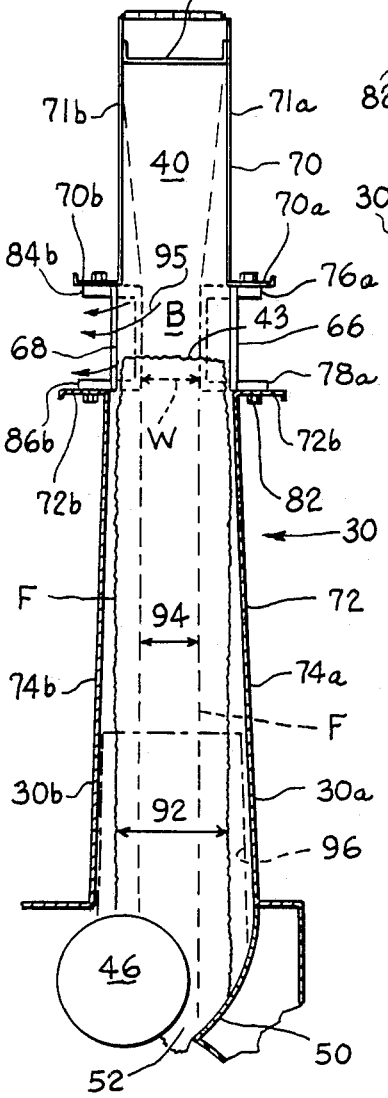
FIG. 4 is a sectional view taken along line 4—4 of FIG. 3.
Figure 8:
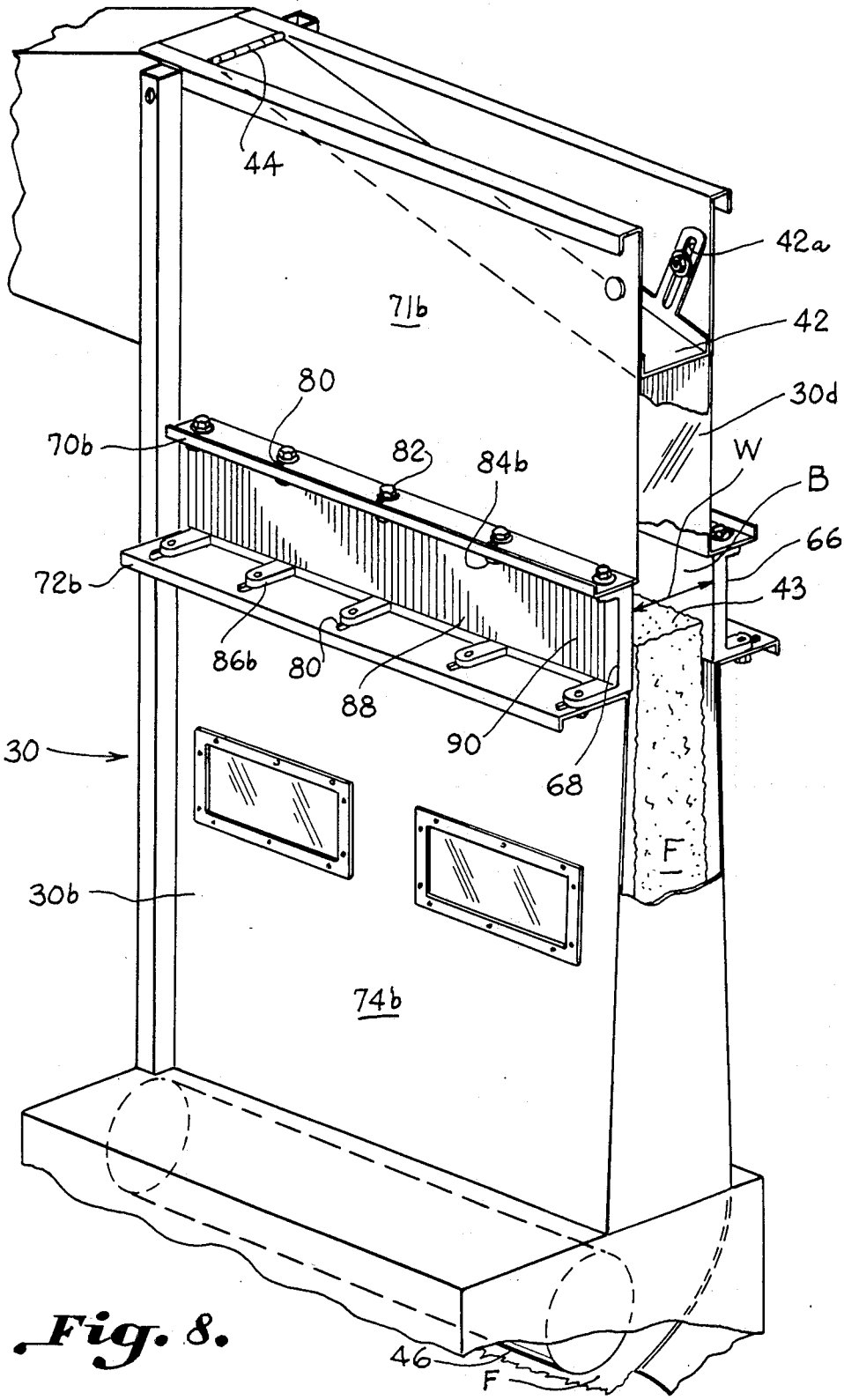
FIG. 8 is a perspective view of a reserve section for a chute feed constructed in accordance with the present invention.

Mounting means for adjustably positioning the movable walls includes a pair of horizontal flanges 70*a* and 70*n* carried by a top portion 70 of the reserve section, as can best be seen in FIGS. 4 and 8. Top portion 70 includes a said front panel 71*a* and rear panel 71*b*. Spaced vertically below flanges 70*a* and 70*b* is a second pair of horizontal flanges 72*a* and 72*b* of a bottom portion 72 of the reserve section. It will be noted that the bottom portion 72 includes a solid front panel 74*a* and a rear panel 74*b* which taper outwardly slightly toward the top feed roll 46. Panel 71*a* and panel 74*a* form the front wall 30*a* of the reserve section. Likewise, the wall 30*b* of the reserve section includes panel 71*b* and 74*b*.

The movable wall element 66 includes a horizontal flange 76*a* mating with flange 70*a*, and a second horizontal flange 78*a* mating with flange 72*a*. There is a plurality of elongate slots 80 formed in the flanges 70*a* and 72*a* in alignment with each other. There is a threaded fastener 82 received through the slots which is threaded into the flanges 76*a* and 78*a*. The wall element 66 may be moved laterally by loosening the threaded members 82 and sliding the same in the slots 80 until a desired position is reached whereupon the threaded fasteners may be tightened.

The movable wall 68 includes a top flange 84*b* and a bottom flange 86*b* which mate respectively with the flanges 70*b* and 72*b*. Slots 80 are formed in the flanges 70*b* and 72*b*, and threaded fasteners 82 are threaded in the flanges 84*b* and 86*b*. The movable wall 68 may be moved in an identical manner to that previously described for the movable wall 66. Referring in more detail to the movable wall element 68, it can be seen that there is a plurality of open vertical air passages 88 between partitions 90 so that the movable wall resembles a grille element. The vertical air passages 88 are partitions 90 allow the fibers to slide past the movable wall element 68 through the throat B without interruption as may occur with circular holes or other irregular openings.

Figure 5:
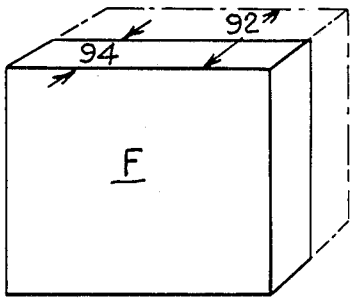
FIG. 5 is a perspective view of various fiber columns of various widths formed in accordance with a reserve section constructed in accordance with the present invention.

Referring now to FIGS. 4 and 5, the formation of various fiber columns having varying widths and shapes are illustrated. With the variable throat B set with the movable walls 66 and 68 in a full line position of FIG. 4, a fiber column 92 is formed as shown in full lines. The fiber column 92 has a width shown at 92 in FIG. 5. If a more narrow fiber column is desired in the reserve chute 40 at the lower portion 40*a* thereof, the movable walls 66 and 68 are moved to the dotted line position shown in FIG. 4. At the same time, the panels 71*b* and 71*a* of the upper section 70 of the reserve section assume the dotted line positions so that they taper inwardly to the variable throat B created by the inward movement of the movable walls. The fibers thus progress smoothly down through the vertical chute 40 of the reserve section. Descending through the throat B, the fibers are compacted and shaped in the form of a fiber column 94 shown in dotted lines in FIG. 4. This fiber column has a width generally equal to half that of the fiber column 92 as can best be seen in FIG. 5. The width of the variable throat B may be adjusted as desired to provide a fiber column having a desired width and weight. The prescribed shape of the fiber column will depend mainly on the type fiber being fed.

The transport air 95 leaves the reserve shute 40 above the fiber column F through the perforated wall 68. The compaction of fibers at the bottom of the chute 40*b* is avoided as occurs with the prior art. The compaction of fibers is shown in dotted lines 96 as often occurs with the prior art chutes in which the panels 74*b* and 74*a* are typically screen material or perforated panels so that the air carries the fibers down to the bottom of the chute at 96 where they are compacted before exiting. The width, W, is adjusted to maintain the fibers in the column F, 94 and 92, for example, out of contact with the front and rear panels 74*a* and 74*b* of the chute 40 to avoid drag. The width will also prescribe the weight and shape of the fiber column along the axial length of feed roll 46. By providing an even weight along the feed roll, uniform feeding of fibers into formation section 32 and discharge of a fiber batt 16 of uniform density across its width are provided.

Referring now to FIG. 6, the movable walls 6 and 68, which are flexible, are illustrated in a position wherein the walls are bowed outwardly to provide a throat B having a concave cross-section in the shape of FIG. 6A. This can be accomplished by loosening the fasteners 82 and bowing out the movable walls as desired. The fasteners 82 can then be tightened down in the slots 80. A fiber column 98 is produced below the variable throat section having curved, concave walls 99 as shown in FIG. 6A which is advantageous in some applications.

FIG. 7 illustrates the movable wall elements 66 and 68 configured to bow inwardly providing a throat B which forms a convex fiber column 100 with convex surfaces 102. Once again the movable plates are adjusted by loosening the fasteners 82 and positioning them in the slots to form the wall sections curved as shown whereupon the fasteners are tightened. The resulting fiber column 100 thus has a convex cross-section as shown in FIG. 7A which is desirable in some applications.

In accordance with the method of the present invention, fibers are introduced into a reserve section of a chute feed and may be deflected so that the fibers are deposited in the chute with a level surface. Other surface contours may also be provided to meet the particular needs of an application, or fiber type. Next, the fibers are passed through an adjustable throat and compacted and shaped to form a fiber column having a desired width and/or cross-section. Thus a fiber column having a desired width and shape as well as a desired contoured top surface is provided to meet the needs of a particular application and fiber type. The weight of the column of fibers produced by the throat section is evenly distributed along the top feed roll and fed accurately bh the top feed roll into the formation section. Column disturbing influences such as drag and overcompaction are avoided. The transport air transporting the fibers to the reserve section is removed above the fiber column so that compaction and uniformity of the fiber column is assured. A single perforated movable wall element is utilized to deliver the transport air outwardly from the reserve section. It has been found that making both movable wall elements slotted does not provide satisfactory air removal and formation. In accordance with the method, the adjustable throat section is provided by movable wall elements which may be bowed inwardly or outwardly to provide a fiber column having a convex or concave cross-section, respectively.

The level 43 of the top of the column of fibers F is maintained between the movable wall elements 66, 68 as can best be seen in FIGS. 8 and 4. For this purpose, the amount of fibers delivered into the reserve section 30 can be controlled in a conventional manner; for example, electronic control of the transport blower speed and/or weight of fiber delivered in response to a pressure sensor at 110. The speed of the opening room machinery may be controlled to vary the weight of fiber delivered in a conventional manner. If the fiber level drops below the air exit 68, the pressure will drop correspondingly. Blower speed and fiber delivery will be increased. If the level obscures the air exit sufficiently, the pressure will increase cutting off or slowing down the transport blower to decrease fiber delivery.

Thus it can be seen that an advantageous construction can be had for a chute feed in accordance with the present invention wherein the reserve section can form a fiber column for feeding to a top feed roll in a desired shape, width, and cross-section to suit the needs of a particular application being made. The fibers are compacted in a proper column for uniform feeding by the feed roll into the formation chute. The fibers are uniformly compacted along the length of the formation chute and discharged in a fiber batt having an even density across its width.

While a preferred embodiment of the invention has been described using specific terms, such description is for illustrative purposes only, and it is to be understood that changes and variations may be made without departing from the spirit or scope of the following claims.

What is claimed is:

1. A chute feed for feeding a fibrous batt to a carding machine and the like of the type which includes an upper reserve section having a vertical chute; a lower formation section having a vertical chute; a top feed roll whose axis extends lengthwise along said chute carried between said reserve section and said formation section for feeding fiber to said formation section; and opening roll carried adjacent said top feed roll for opening fibers fed by said top feed roll; and said reserve section including a front wall, a back wall, with integral side walls bridging said front and back walls and an entrance opening formed in one of said side walls adjacent an upper portion of said reserve section; wherein said chute feed further comprises:

a first movable wall element carried along the length of said front wall of said reserve section;

a second movable wall element carried by said back wall opposite said first movable wall element;

said first and second wall elements mounted lengthwise along said chute extending in the same direction as said top feed roll for movement towards and away from each other to vary the width of a cross-section of said reserve chute transverse to fiber descent and define an adjustable throat in said reserve chute by which said fibers are compacted and shaped into a fiber column above said top feed roll having a prescribed shape and weight; and one of said wall elements including air passage openings facilitating passage of air outwardly from said reserve section.

2. The apparatus of claim 1 including means for mounting said movable wall elements for linear movement towards and away from each other and for fixing said movable wall elements at a desired position.

3. The apparatus of claim 2 including means for tapering upper portions of said front wall and back wall of said reserve section inwardly so said wall portions taper to a width corresponding generally to the width between said first and second movable wall elements to provide a smooth transition and flow of said fibers into said throat for compaction.

4. The apparatus of claim 2 wherein said means for positioning and fixing said movable wall elements provides for said wall elements to be positioned so that a fiber column having a rectangular cross-section, a concave cross-section, or a convex cross-section may be formed between said movable wall elements as desired.

5. The apparatus of claim 1 wherein said air passage openings in said one wall element consist of vertical slot openings defined by vertical partitions formed in said wall element which facilitate downward passage of said fiber in a sliding action through said throat.

6. The apparatus of claim 1 including an inclined vane having one end pivotally attached to a top portion of said entrance of said reserve section and a remote end terminating adjacent an opposite side of said reserve section remote from said entrance of said reserve section, said vane means deflecting said airflow downwardly to deposit fibers into a column having a generally level top surface whereby the weight of said fiber column is distributed evenly along the length of said reserve chute.

7. The apparatus of claim 6 wherein said pivotal air deflection vane coextends with the cross-section of said reserve chute to form an upper closure for said chute upon which said fiber-laden airflow impinges and is deflected.

8. Apparatus for uniformly supplying fibers to a chute feed system of the type wherein fibers are transported by air from a fiber opening machine to a chute feed for discharge in the form of a fiber batt; said chute feed comprising an upper reserve section and a lower formation section each having a vertical chute, a feed roll extending along the length of said chute below said reserve section chute for feeding fibers to said formation section; a pair of bottom delivery rolls carried at the bottom of said formation section for discharging said fiber batt; an oscillating compaction plate carried adjacent said bottom delivery rolls for compressing and compacting said fibers prior to delivery from said chute feed; said reserve section including a front wall, a back wall spaced from said front wall, and integral side walls adjoining said front and back walls, and an entrance opening adjacent an upper portion of said reserve section formed in one of said side walls; wherein said apparatus further comprises:

an adjustable width throat means formed below said entrance opening in said chute of said reserve section carried by said front and back walls along generally the entire length of said chute extending generally in the same direction as said feed roll in a manner that a width between said front and back walls may be constricted causing said fibers to be compacted and shaped to form a fiber column of a prescribed width and shape in said reserve chute above said feed roll.

9. The apparatus of claim 8 including air passage means formed in said reserve chute adjacent said adjustable throat through which fiber transport air exits outwardly from said reserve chute in the area of said adjustable throat.

10. The apparatus of claim 9 including an inclined vane carried in an upper portion of said reserve chute having one end carried adjacent said entrance of said reserve section and a remote end terminating adjacent the opposing side of said reserve section, said vane having a width sufficient to act as a top for said reserve chute and to close the upper portion of said chute at a desired angle of inclination to deflect said fibers downwardly to form a fiber column having a desired profile across the top thereof.

11. Apparatus for supplying fibers to a carding machine and the like of a type which includes a vertical feed chute comprising:

a vertical chute having opposing sidewalls and front and back walls through which said fibers descend having an entrance adjacent an upper portion to which fibers are transported by transport air;

a feed roll extending lengthwise in said chute between said sidewalls and carried at the bottom of said chute;

an adjustable width throat means extending lengthwise in said chute above said feed roll for variably constricting a width between said front and back walls in said chute below said entrance opening through which said fibers pass and descend in a manner that said fibers are compacted and shaped forming a uniformly shaped fiber column above said feed roll; and air passage means formed in said chute at said throat means facilitating removal of said transport air adjacent said throat means so that said fibers are separated from said transport air for compaction and shaping of said fiber column.

12. The apparatus of claim 11 wherein said air passage means includes a plurality of vertical openings formed in said throat means by vertical partitions which facilitate the flow of fibers vertically through said throat means.

13. The apparatus of claim 11, including air deflection means carried at a top portion of said entrance of said vertical chute which closes substantially the entire top portion of said chute whereby said transport air is caused to impinge thereon and deflect downwardly to form a fiber column having a top surface with a desired fiber profile.

14. The apparatus of claim 11 wherein said throat means is variable in cross-sections and includes a pair of spaced, opposed wall elements carried in said chute and means for adjusting said wall elements in lateral displacement relative to each other to vary the distance therebetween and the effective width of said throat between which said fibers are compacted.

15. The apparatus of claim 14 wherein said opposed wall elements are flexible and may be bowed to produce a fiber column having a correspondingly shaped, curved wall surface.

16. The apparatus of claim 14 wherein said air passage means includes air passage openings formed in one of said movable wall elements.

17. The apparatus of claim 11 wherein said throat means includes variably contoured wall elements carried across the entire length of said chute; and means for varying the contour of said wall elements and providing a curved cross-section for said chute transverse to fiber descent.

* * * * *